US007408513B1

(12) United States Patent
Yanagi et al.

(10) Patent No.: US 7,408,513 B1
(45) Date of Patent: Aug. 5, 2008

(54) ANTENNA APPARATUS

(75) Inventors: Masahiro Yanagi, Shinagawa (JP); Shigemi Kurashima, Shinagawa (JP); Hideki Iwata, Shinagawa (JP); Takashi Yuba, Shinagawa (JP); Masahiro Kaneko, Shinagawa (JP); Yuriko Segawa, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/580,910

(22) Filed: Oct. 16, 2006

(30) Foreign Application Priority Data

Mar. 30, 2006 (JP) ..... 2006-094459

(51) Int. Cl.
*H01Q 1/38* (2006.01)
*H01Q 1/50* (2006.01)

(52) U.S. Cl. ..... 343/700 MS; 343/702; 343/906; 343/846

(58) Field of Classification Search ..... 343/700 MS, 343/846, 702, 906
See application file for complete search history.

(56) References Cited

U.S. PATENT DOCUMENTS 6,509,877 B2 * 1/2003 Masaki ..... 343/702
6,642,892 B2 * 11/2003 Masaki et al. ..... 343/702

FOREIGN PATENT DOCUMENTS

JP 2000-196327 7/2000

OTHER PUBLICATIONS

2003 IEICE (The Institute of Electronics, Information and Communication Engineers) General Conference, Mar. 22, 2003, Room B201, B-1-133: An Omnidirectional and Low-VSWR Antenna for the FCC-Approved UWB Frequency Band, Takuya Taniguchi and Takehiko Kobayashi (Tokyo Denki University).

* cited by examiner

*Primary Examiner*—Hoang V Nguyen
(74) *Attorney, Agent, or Firm*—Staas & Halsey LLP

(57) ABSTRACT

A disclosed antenna apparatus includes a base made of a dielectric material; an antenna element pattern formed on a surface of the base; a ground pattern formed in a position adjacent to and opposite to the antenna element pattern on the same surface of the base; and a surface-mounted coaxial connector mounted on the ground pattern in a position close to a feeding point of the antenna element pattern.

7 Claims, 7 Drawing Sheets

100
101
102
200
104

100
101
104
200
102

104
102a
s
a
104a
200
101
102
101a
110
103
120
121

ANTENNA APPARATUS

BACKGROUND OF THE INVENTION

1. Field of the Invention

The present invention generally relates to an antenna apparatus, and more particularly relates to a planar antenna apparatus using UltraWideBand (UWB).

2. Description of the Related Art

In recent years, wireless communication technologies using UltraWideBand (UWB) have gotten a lot of attention because of UWB's wide range of applications such as radar positioning and high capacity transmission. In 2002, the Federal Communications Commission (FCC) of the United States approved the use of UWB in the frequency band between 3.1 and 10.6 GHz.

UWB is a transmission system using ultrawideband signals for communication. An antenna used for UWB must be capable of sending/receiving ultrawideband signals.

An antenna, which is composed of a base board and a power feeder, for use in the frequency band between 3.1 and 10.6 GHz approved by FCC has been proposed (non-patent document 1).

FIGS. 1A and 1B are perspective views of exemplary conventional antenna apparatuses. An antenna apparatus 10 shown in FIG. 1A has a structure where a power feeder 12 shaped like an inverted cone is placed on a base board 11. The side surface of the cone-shaped power feeder 12 forms an angle θ with the axis of the antenna apparatus 10. The angle θ provides characteristic features of the antenna apparatus 10.

An antenna apparatus 20 shown in FIG. 1B has a structure where a teardrop-shaped power feeder 22 composed of an inverted cone 22*a* and a sphere 22*b* is placed on a base board 11. The sphere 22*b* is in contact with the internal surface of the inverted cone 22*a*.

[Non-patent document 1] 2003 IEICE (The Institute of Electronics, Information and Communication Engineers) General Conference, Mar. 22, 2003, Room B201, B-1-133: An Omnidirectional and Low-VSWR Antenna for the FCC-Approved UWB Frequency Band, Takuya Taniguchi and Takehiko Kobayashi (Tokyo Denki University)

[Patent document 1] Japanese Patent Application Publication No. 2000-196327

As described above, a conventional wide-band antenna apparatus normally has a structure where a cone-shaped or teardrop-shaped power feeder is placed on a base board. Because of this structure, a conventional wide-band antenna apparatus is normally large in size, and therefore there has been demand for a more compact and thinner antenna apparatus.

FIGS. 2A and 2B are perspective views of a planar UWB antenna apparatus 30 disclosed in the specifications and drawings of Japanese Patent Application No. 2006-91602 filed by the same applicant. The planar UWB antenna apparatus 30 is a compact and thin antenna apparatus. The planar UWB antenna apparatus 30 includes an antenna element pattern 32, a stripline 33, and two ground patterns 34 and 35 formed on an upper surface 31*a* of a base 31 made of a dielectric material. Also, a coaxial connector 50 is mounted on an edge of the base 31.

The ground patterns 34 and 35 form ground potential regions near the antenna element pattern 32 and thereby generate lines of electric force around the antenna element pattern 32. Also, the ground patterns 34 and 35 constitute a part of a microwave transmission line 40 of a Coplanar waveguide type.

The stripline 33, the ground patterns 34 and 35, and the base 31 form the microwave transmission line 40 of a Coplanar waveguide type. The coaxial connector 40 is soldered onto the stripline 33 and the ground patterns 34 and 35 at the end of the microwave transmission line 40 of a Coplanar waveguide type extending from the antenna element pattern 32.

The planar UWB antenna apparatus 30 is used in the frequency band between 3 and 6 GHz.

The line Ia in FIG. 6 shows VSWR (voltage standing wave ratio) vs. frequency characteristics of the planar UWB antenna apparatus 30. A preferable value of VSWR is 1.4 or lower. However, as indicated by the line Ia in FIG. 6, the VSWR of the planar UWB antenna apparatus 30 is higher than 3.0 around 3 GHz, and therefore there is demand for improvement.

SUMMARY OF THE INVENTION

The present invention provides an antenna apparatus that substantially obviates one or more problems caused by the limitations and disadvantages of the related art.

According to an embodiment of the present invention, an antenna apparatus includes a base made of a dielectric material; an antenna element pattern formed on a surface of the base; a ground pattern formed in a position adjacent to and opposite to the antenna element pattern on the same surface of the base; and a surface-mounted coaxial connector mounted on the ground pattern in a position close to a feeding point of the antenna element pattern.

DETAILED DESCRIPTION OF THE PREFERRED EMBODIMENTS

Figure 1A:
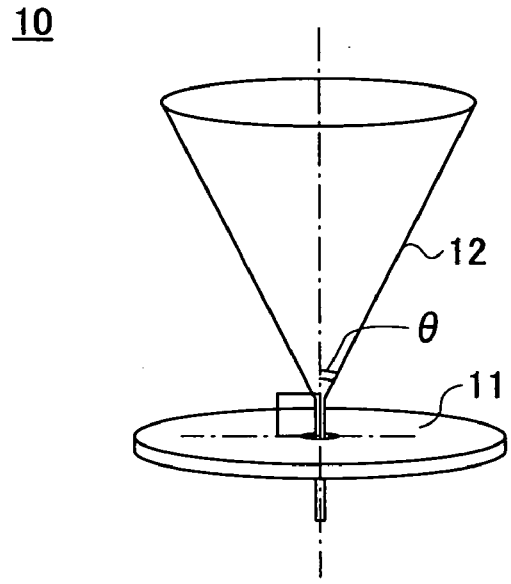
FIGS. 1A and 1B are perspective views of exemplary conventional antenna apparatuses.
Figure 1B:
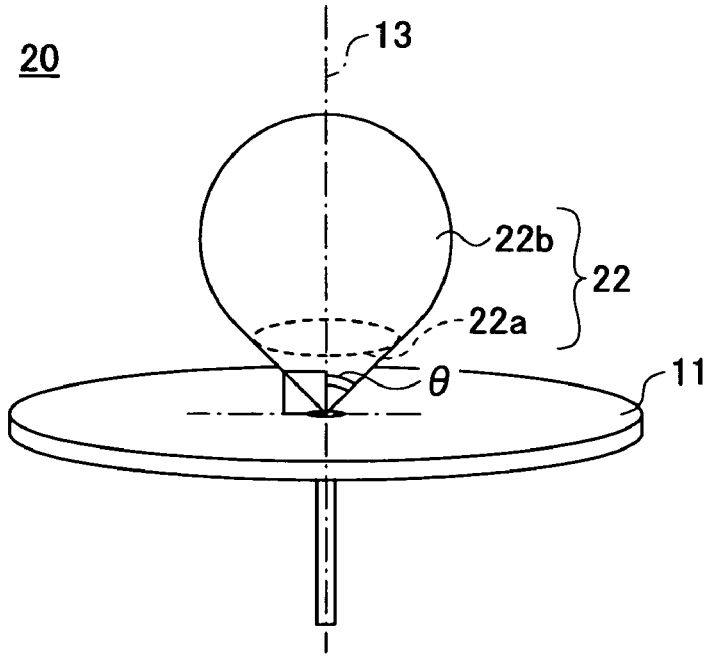

Preferred embodiments of the present invention are described below with reference to the accompanying drawings.

1. First Embodiment

FIGS. 3A through 4C are drawings illustrating a planar UWB antenna apparatus 100 according to a first embodiment of the present invention. Arrows Z1-Z2 show the directions along the axis of the planar UWB antenna apparatus 100 (directions along the length of a base 101), X1-X2 show directions along the width of the base 101, and Y1-Y2 show directions along the thickness of the base 101.

The planar UWB antenna apparatus 100 includes an antenna element pattern 102, a short stripline 103 with a length of about 1 mm, and a ground pattern 104 formed on an upper surface 101*a* of a base 101 made of a dielectric material. Also, a surface-mounted socket coaxial connector 200 is placed in a position close to a projecting point (feeding point) 102*a* of the antenna element pattern 102 so as to span a gap between the end of the stripline 103 and the ground pattern 104.

Figures 4A, 4B, 4C:
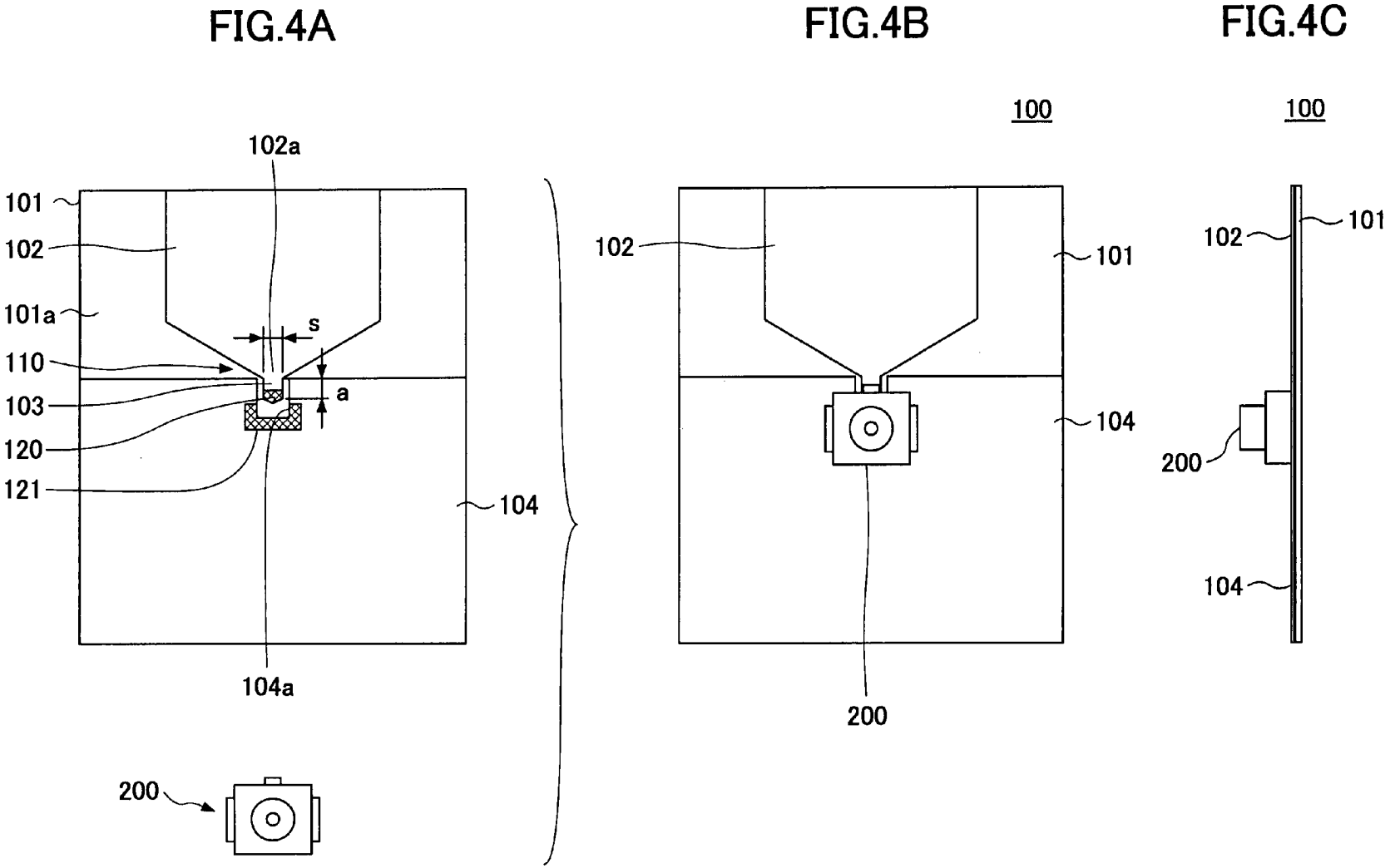
FIGS. 4A, 4B, and 4C are drawings illustrating the exemplary planar UWB antenna apparatus shown in FIGS. 3A and 3B.

As shown in FIG. 4A, the antenna element pattern 102 is shaped like a home plate. Each of the two inclined sides extending from the projecting point (feeding point) 102*a* of the antenna element pattern 102 forms an angle θ of about 60 degrees with the axis of the planar UWB antenna apparatus 100. The stripline 103 has a length a and extends from the projecting point (feeding point) 102*a* of the antenna element pattern 102 in the Z2 direction. The length a is about 1 mm. The ground pattern 104 is shaped like a rectangle and positioned adjacent to and opposite to the antenna element pattern 102. The ground pattern 104 has a recess 104*a* in a position facing the feeding point 102*a* of the antenna element pattern 102. The stripline 103 extends into the recess 104*a*.

The stripline 103, a part of the ground pattern 104 which part faces the stripline 103, and the base 101 form a microwave transmission line 110 of a Coplanar waveguide type. The microwave transmission line 110 has an impedance of about 50Ω.

The ground pattern 104 forms ground potential regions near the antenna element pattern 102 and thereby generates lines of electric force around the antenna element pattern 102.

A land 120 is formed on the edge of the stripline 103 and a land 121 is formed on an area surrounding the recess 104*a* of the ground pattern 104. The socket coaxial connector 200 is mounted on the lands 120 and 121.

Figure 5A:
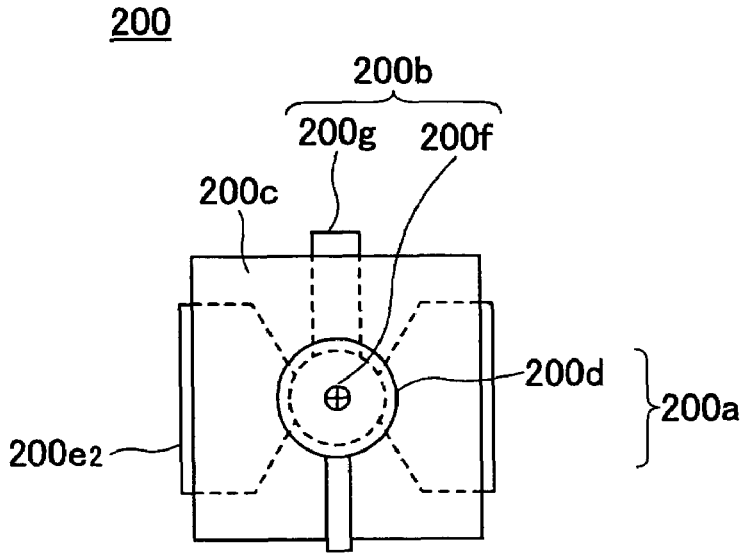
FIGS. 5A through 5*c* are drawings illustrating an exemplary socket coaxial connector.
Figure 5B:
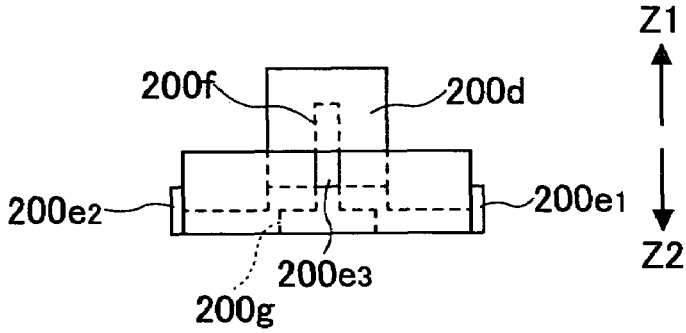
Figure 5C:
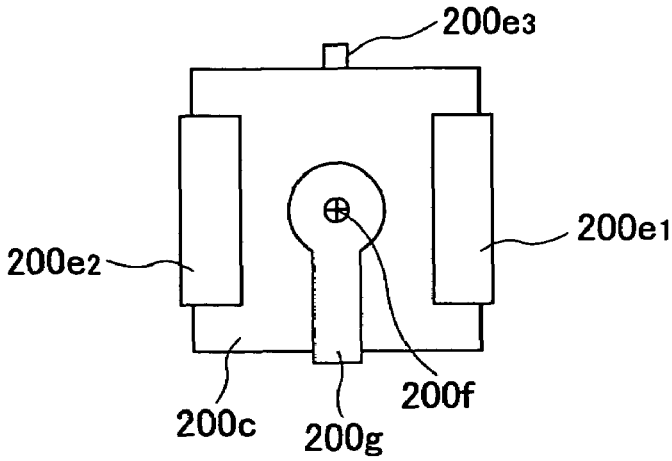

As shown in FIGS. 5A through 5C, the socket coaxial connector 200 is surface-mountable and has a structure where a shielding unit 200*a* and a signal line connecting unit 200*b* are integrated with a molded insulating part 200*c*.

The shielding unit 200*a* is made of a conductive material and includes a connecting part 200*d* and contacts 200*e*1, 200*e*2, and 200*e*3. The connecting part 200*d* is shaped like a cylinder, protrudes in the Z1 direction, and engages a shield of a plug connector. The contacts 200*e*1, 200*e*2, and 200*e*3 are connected to the connecting part 200*d* and exposed on the bottom surface of the insulating part 200*c* (the surface in the Z2 direction).

The signal line connecting unit 200*b* is made of a conductive material and includes a connecting pin 200*f* and a contact 200*g*. The connecting pin 200*f* is positioned within the connecting part 200*d*, protrudes from the insulating part 200*c* in the Z1 direction, and is connected to a signal line of the plug connector when the plug connector is inserted. The contact 200*g* is connected to the connecting pin 200*f* and exposed on the bottom surface of the insulating part 200*c* (the surface in the Z2 direction).

The socket coaxial connector 200 is surface-mounted by soldering the contact 200*g* onto the land 120 on the edge of the stripline 103 and soldering the contacts 200*e*1 and 200*e*2 onto the land 121 on the ground pattern 104.

Since the microwave transmission line 110 is a Coplanar waveguide type, a line width s of the stripline 103 is as large as 1 mm as shown in FIG. 4A. Therefore, the solder for mounting the socket coaxial connector 200 does not extend beyond the width of the stripline 103. Therefore, the impedance of the part of the microwave transmission line 110 on which part the socket coaxial connector 200 is soldered can be maintained at around 50Ω.

The planar UWB antenna apparatus 100 is usable in the frequency band between 3 and 6 GHz and is used by connecting a plug coaxial connector (not shown) attached to one end of a coaxial cable (not shown) to the socket coaxial connector 200. A high-frequency signal is supplied to the antenna element pattern 102 and the ground pattern 104 is held at ground potential. As a result, lines of electric force are generated between the antenna element pattern 102 and the ground pattern 104.

Figure 6:
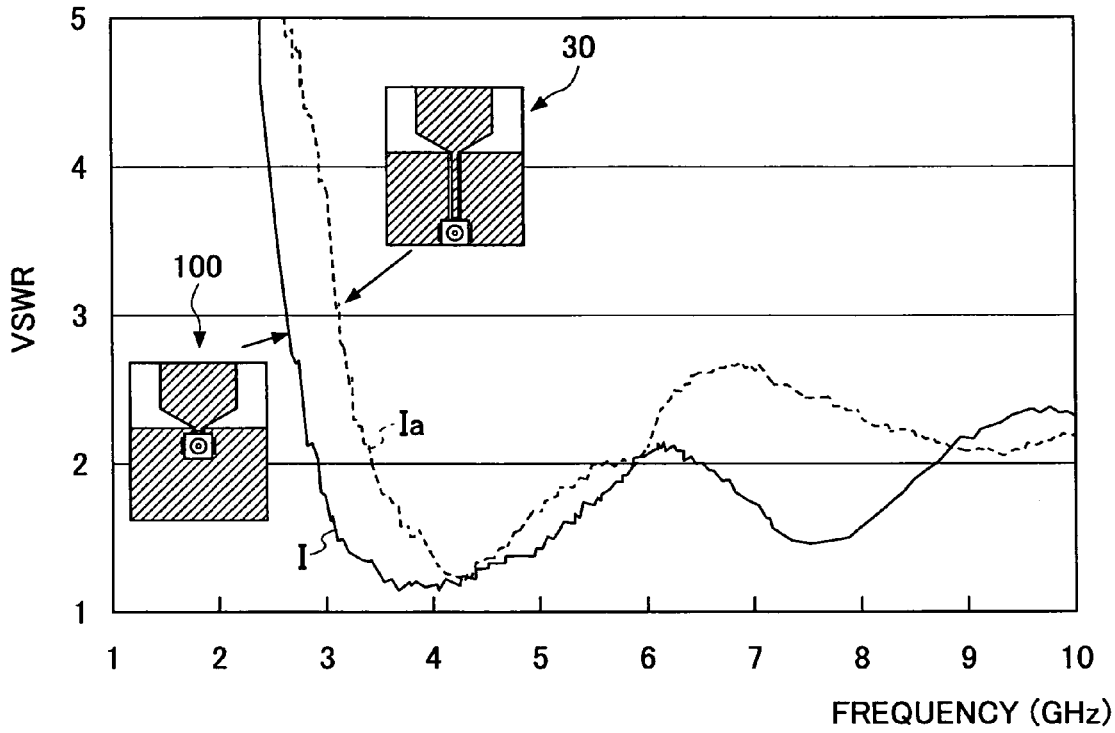
FIG. 6 is a graph showing VSWR vs. frequency characteristics of the exemplary planar UWB antenna apparatus shown in FIGS. 3A and 3B.

In FIG. 6, the line I shows VSWR vs. frequency characteristics of the planar UWB antenna apparatus 100.

Figure 2A:
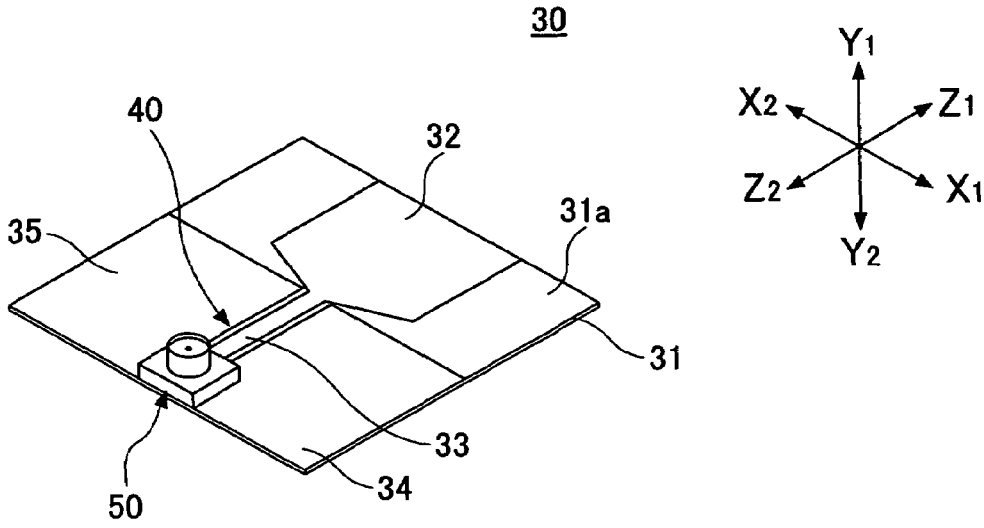
FIGS. 2A and 2B are perspective views of a planar UWB antenna apparatus disclosed in a patent application filed by the same applicant.
Figure 2B:
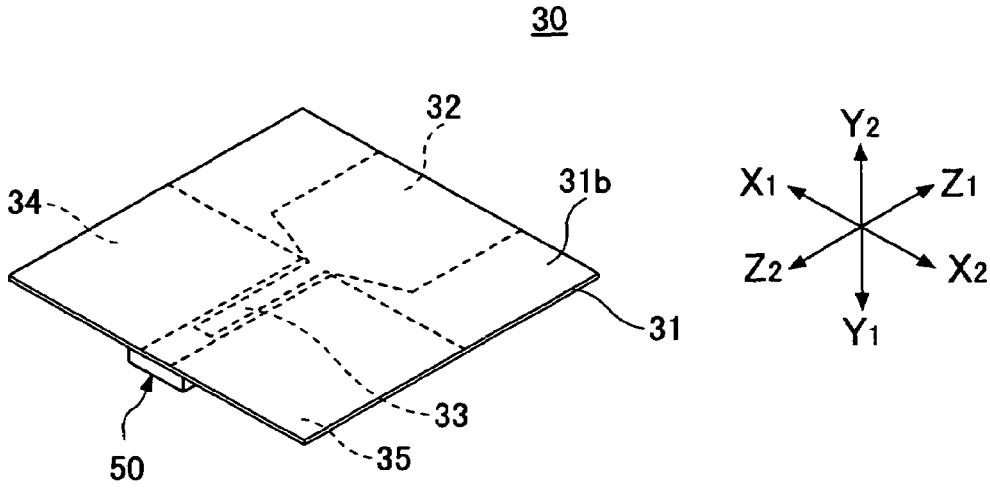
Figure 3A:
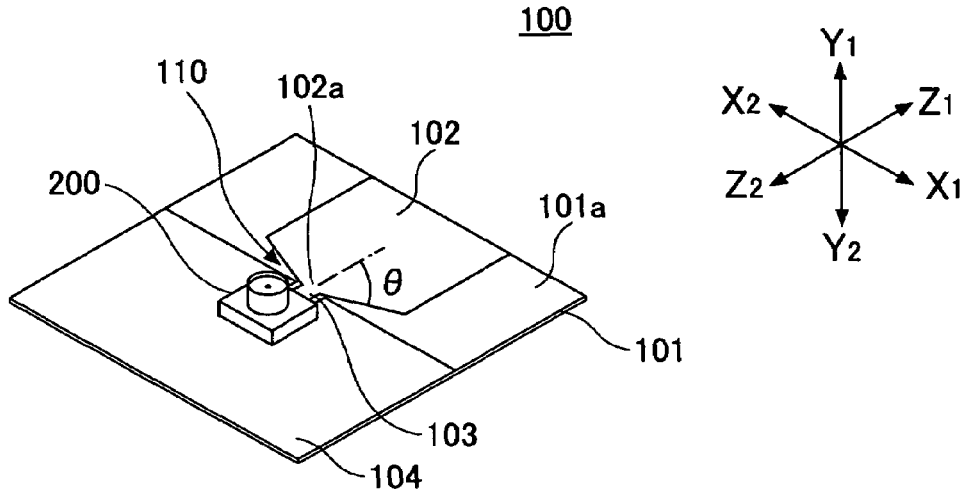
FIGS. 3A and 3B are perspective views of an exemplary planar UWB antenna apparatus according to a first embodiment of the present invention.
Figure 3B:
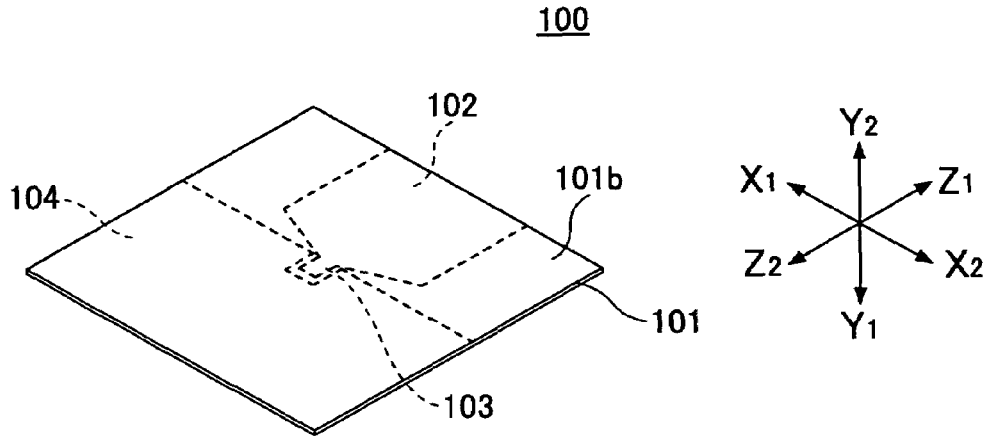

The VSWR vs. frequency characteristics of the planar UWB antenna apparatus 100 and the planar UWB antenna apparatus 30 shown in FIGS. 2A and 2B are compared below in the frequency band between 3 and 6 GHz.

At around 3 GHz, the VSWR of the planar UWB antenna apparatus 100 is about 1.4 and is about a half of the VSWR of the planar UWB antenna apparatus 30.

At around 4 GHz, the VSWR of the planar UWB antenna apparatus 100 is about 1.1 and is substantially the same as the VSWR of the planar UWB antenna apparatus 30.

At around 5 GHz, the VSWR of the planar UWB antenna apparatus 100 is about 1.5 and is about 0.2 lower than the VSWR of the planar UWB antenna apparatus 30.

At around 6 GHz, the VSWR of the planar UWB antenna apparatus 100 is substantially the same as the VSWR of the planar UWB antenna apparatus 30.

The above results show that, in the frequency band between 3 and 6 GHz where the planar UWB antenna apparatuses are used, the VSWR vs. frequency characteristics of the planar UWB antenna apparatus 100 are better than the VSWR vs. frequency characteristics of the planar UWB antenna apparatus 30.

Possible reasons of the above improvement in VSWR vs. frequency characteristics are as follows:

(1) The planar UWB antenna apparatus 100 includes only one ground pattern, the ground pattern 104. Because of this structure, a half of the ground pattern 104 corresponding to the X1 side of the antenna element pattern 102 and the other half of the ground pattern 104 corresponding to the X2 side of the antenna element pattern 102 show the same ground potential.

(2) The socket coaxial connector 200 is mounted on the ground pattern 104 in a position close to the antenna element pattern 102. Because of this structure, the ground potential of the half of the ground pattern 104 corresponding to the X2 side of the antenna element pattern 102 becomes stable.

2. Second Embodiment

Figures 7A, 7B:
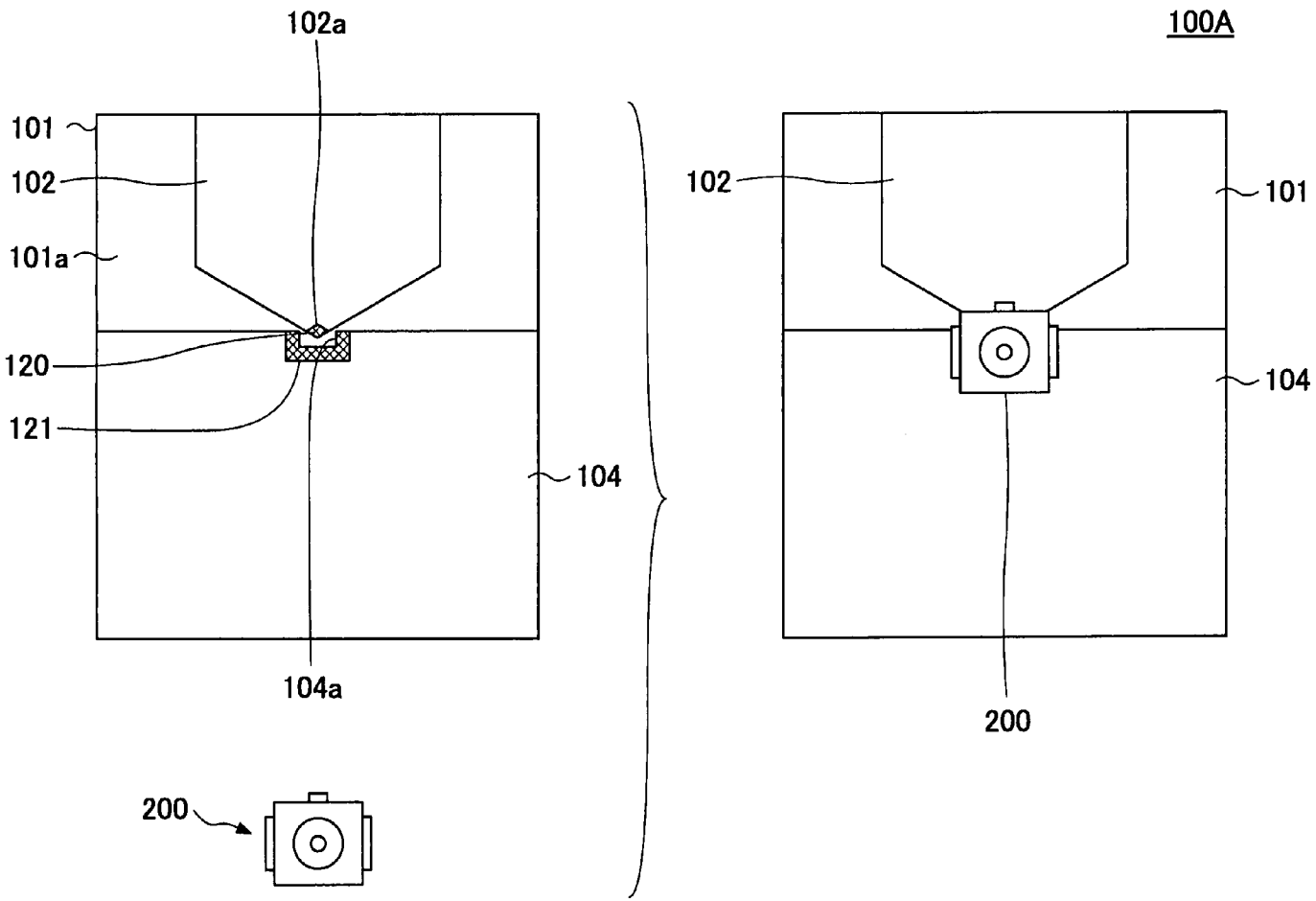
FIGS. 7A and 7B are drawings illustrating an exemplary planar UWB antenna apparatus according to a second embodiment of the present invention.

FIGS. 7A and 7B are drawings illustrating a planar UWB antenna apparatus 100A according to a second embodiment of the present invention.

Unlike the planar UWB antenna apparatus 100, the planar UWB antenna apparatus 100A does not have a microwave transmission line of a Coplanar waveguide type. In the planar UWB antenna apparatus 100A, the socket coaxial connector 200 is soldered onto the land 120 formed on the feeding point 102*a* of the antenna element pattern 102 and onto the land 121 formed on a part of the ground pattern 104 which part faces the feeding point 102*a* so as to span a gap between the antenna element pattern 102 and the ground pattern 104. The contact 200*g* of the socket coaxial connector 200 is soldered directly onto the feeding point 102*a* of the antenna element pattern 102.

The planar UWB antenna apparatus 100A shows substantially the same VSWR vs. frequency characteristics as those indicated by the line I shown in FIG. 6.

A planar UWB antenna apparatus according to an embodiment of the present invention includes an antenna element pattern, one ground pattern, and a surface-mounted coaxial connector mounted on the ground pattern in a position close to a feeding point of the antenna element pattern. Such a configuration stabilizes the ground potential of the ground pattern and thereby improves the VSWR vs. frequency characteristics of a planar UWB antenna apparatus.

The present invention is not limited to the specifically disclosed embodiments, and variations and modifications may be made without departing from the scope of the present invention.

The present application is based on Japanese Priority Application No. 2006-094459 filed on Mar. 30, 2006, the entire contents of which are hereby incorporated by reference.

What is claimed is:

1. An antenna apparatus, comprising:

a base made of a dielectric material;

an antenna element pattern formed on a surface of the base;

a ground pattern formed in a position adjacent to and opposite to the antenna element pattern on the same surface of the base; and a surface-mounted coaxial connector mounted on the ground pattern in a position close to a feeding point of the antenna element pattern, wherein the antenna apparatus has a planar shape.

2. The antenna apparatus as claimed in claim 1, wherein the coaxial connector is mounted on the ground pattern and spans a gap between the antenna element pattern and the ground pattern.

3. The antenna apparatus as claimed in claim 1, wherein:

the coaxial connector is mounted on the ground pattern in a position to stabilize the ground potential of the ground pattern.

4. The antenna apparatus as claimed in claim 1, wherein the antenna apparatus is used in a frequency band between 3 and 6 GHZ.

5. The antenna apparatus as claimed in claim 1, wherein the antenna element pattern is shaped like a home plate.

6. An antenna apparatus, comprising:

a base made of a dielectric material;

an antenna element pattern formed on a surface of the base;

a ground pattern formed in a position adjacent to and opposite to the antenna element pattern on the same surface of the base;

a stripline extending from a feeding point of the antenna element pattern into a recess formed in the ground pattern; and a surface-mounted coaxial connector soldered onto a part of the ground pattern which part surrounds the recess and onto a part of the stripline.

7. An antenna apparatus, comprising;

a base made of a dielectric material;

an antenna element pattern formed on a surface of the base;

a ground pattern formed in a position adjacent to and opposite to the antenna element pattern on the same surface of the base; and a surface-mounted coaxial connector soldered onto a feeding point of the antenna element and onto a part of the ground pattern which part faces the feeding point.

* * * * *

UNITED STATES PATENT AND TRADEMARK OFFICE

CERTIFICATE OF CORRECTION

PATENT NO. : 7,408,513 B1
APPLICATION NO. : 11/580910
DATED : August 5, 2008
INVENTOR(S) : Masahiro Yanagi et al.

It is certified that error appears in the above-identified patent and that said Letters Patent is hereby corrected as shown below:

Column 6, Line 22, change “comprising;” to --comprising:--.

Signed and Sealed this

Thirteenth Day of January, 2009

JON W. DUDAS
*Director of the United States Patent and Trademark Office*